US007437793B2

(12) United States Patent
Lane

(10) Patent No.: US 7,437,793 B2
(45) Date of Patent: Oct. 21, 2008

(54) SPIKED GOLF SHOE CLEANING BRUSH

(76) Inventor: Joseph Lane, 29 Silver Spring Park, Ridgefield, CT (US) 06877

( * ) Notice: Subject to any disclaimer, the term of this patent is extended or adjusted under 35 U.S.C. 154(b) by 500 days.

(21) Appl. No.: 10/990,981

(22) Filed: Nov. 17, 2004

(65) Prior Publication Data

US 2006/0101599 A1 May 18, 2006

(51) Int. Cl.
*A47L 13/02* (2006.01)
*A47L 13/12* (2006.01)
*A47L 23/04* (2006.01)

(52) U.S. Cl. ..... 15/113; 15/236.06; 15/237

(58) Field of Classification Search ..... 15/111, 15/112, 142, 161, 236.01, 237, 113, 236.06
See application file for complete search history.

(56) References Cited

U.S. PATENT DOCUMENTS

| | | | | | |
|---|---|---|---|---|---|
| 939,290 | A | * | 11/1909 | Myers | 15/142 |
| 1,578,074 | A | * | 3/1926 | Chandler | 15/188 |
| 1,689,209 | A | * | 10/1928 | Majewski | 15/142 |
| 2,564,721 | A | * | 8/1951 | Raya | 15/142 |
| 2,857,607 | A | * | 10/1958 | South | 15/104.001 |
| 2,980,936 | A | * | 4/1961 | Snow et al. | 15/113 |
| 3,100,309 | A | * | 8/1963 | Gambino | 15/167.1 |
| 3,111,698 | A | * | 11/1963 | Reichle | 15/105 |
| 3,270,363 | A | * | 9/1966 | Harris, Jr. | 15/237 |
| 3,310,826 | A | * | 3/1967 | Ellis | 15/105 |
| 3,838,474 | A | * | 10/1974 | Erickson | 15/142 |
| 4,244,168 | A | * | 1/1981 | Howard | 56/400.17 |
| 4,493,125 | A | * | 1/1985 | Collis | 15/167.2 |
| 4,670,932 | A | | 6/1987 | Williams | |
| 5,022,650 | A | | 6/1991 | Madock | |
| 5,027,463 | A | * | 7/1991 | Daub | 15/22.1 |
| 5,230,117 | A | | 7/1993 | Johnson et al. | |
| 5,325,560 | A | * | 7/1994 | Pavone et al. | 15/106 |
| 5,345,641 | A | | 9/1994 | Webster | |
| 5,694,660 | A | | 12/1997 | Rachwalski | |
| 5,930,862 | A | * | 8/1999 | Garrett | 15/200 |
| 6,032,316 | A | | 3/2000 | Peake et al. | |
| 6,067,684 | A | * | 5/2000 | Kweon | 15/167.1 |
| 6,243,907 | B1 | | 6/2001 | Wagner | |
| 6,256,830 | B1 | | 7/2001 | Jolly | |
| 6,374,449 | B1 | | 4/2002 | Jolly | |
| 6,651,288 | B1 | | 11/2003 | Hackett | |
| 6,732,397 | B2 | | 5/2004 | Thompson | |

* cited by examiner

*Primary Examiner*—Randall Chin
(74) *Attorney, Agent, or Firm*—St. Onge Steward Johnston & Reens LLC

(57) ABSTRACT

An athletic shoe cleaning device includes cleaning teeth affixed to a handle. Pairs or opposed cleaning teeth are provided which have a first section and a second section joined by an angle suitable for cleaning golf shoe spikes having multiple nubs or flanges. The cleaning teeth are especially suited for removing debris from circular or softer type golf spikes.

15 Claims, 4 Drawing Sheets

SPIKED GOLF SHOE CLEANING BRUSH

FIELD OF THE INVENTION

This invention relates generally to brushes. More specifically, the invention relates to brushes for cleaning mud and debris from shoes, particularly spiked golf shoes. Most specifically, the invention relates to a spiked golf shoe cleaning brush which may be hand-held and which may be stowed in a golf bag, cart, or other convenient location.

BACKGROUND OF THE INVENTION

As with all sports on natural turf, a player's traction has a significant effect on the quality of the game played. Ideal golf footwear should provide traction on the tees and fairways while taking shots, but at the same time reduce damage to the grounds.

Traditionally, golf shoes had metal spikes of about 5.0 to 10 mm in section on the sole of the shoe to provide golfers with adequate traction. These spikes were problematic in that they damaged greens and fairways and wore down well traveled portions of a golf course. However, in the early 1990's substitute spikes made of plastic were introduced which minimized the wear and tear on the golf course. One such substitute spike is described in U.S. Pat. No. 6,023,860 to McMullin (which is hereby incorporated by reference) which relates to a spike having at least one traction element extending substantially laterally from the flange to engage grass blades to provide traction without damaging turf. The circular or softer type spikes are now widespread for there has been rapid adoption of these spikes throughout much of the golf world. However, although widely accepted, the substitute spikes do not always improve traction. During wet or muddy situations or when lawn clippings are present, the spikes may clog and reduce a golfer's traction. The circularly positioned flanges are sometimes problematic in that they trap debris under the traction nub. These traction problems are compounded in hilly areas where golfers need additional traction to walk up or down hills, or take a stroke on uneven surfaces. Although golfers may routinely brush off their spikes, the rounded shape and design of many of the substitute spikes prevents adequate cleaning. Accordingly, there is a need for a brush that can be used anywhere on the golf course to unclog substitute golf spikes.

A number of cleat brushes have been disclosed in the prior art. U.S. Pat. No. 6,732,397 discloses an attachment for fastening a brush to a shoe having a first horizontal flange extending to a second vertical flange, with the second flange having the cleaning teeth. However, this brush does not have any element suitable for debris removal in state-of-the-art golf spikes. U.S. Pat. No. 4,670,932 discloses a portable tool for cleaning and removing mud from the heels or soles of a cleated shoe. This blade design is not a brush, and also does not have a cleaning teeth suitable for debris removal in state-of-the-art golf spikes. U.S. Pat. No. 5,230,117 discloses a golf shoe and club cleaner attachment for golf bag or other convenient surface. The device includes a brush handle having soft bristles embedded on one face, and bronze bristles embedded in an end wall. However, it does not have a shaped cleaning teeth capable of eliminating debris from modern golf spikes.

Accordingly, what is needed is a brush assembly which facilitates the cleaning of golf shoes anywhere on the golf course. Furthermore, there is a need for a brush assembly which unclogs state-of-the-art golf spikes.

SUMMARY OF THE INVENTION

It is the object of the present invention to provide a brush especially suited to remove debris from rounded golf spikes having multiple nubs.

It is the object of the present invention to provide a brush assembly especially adapted to cleaning state-of-the-art golf spikes.

It is the object of the present invention to improve a golfer's traction by providing an improved cleaning implement.

It is the object of the present invention to provide a brush for unclogging a golfer's spikes in order to improve traction on the tees and fairways while taking shots.

It is the object of the present invention to provide a brush which may be hand-held, or stowed in a golf bag, cart, or other convenient location.

These and other objects of the present invention are met by providing an athletic shoe cleaning device comprising a brush handle having at least one, and preferably more, opposed pairs of cleaning teeth having a first section and a second section joined on an angle, wherein the angle is within the range of from about 85 to 170 degrees. Optionally, the angle is within the range of from about 95 to about 160 degrees. Optionally, the angle is within the range of from about 90 to about 120 degrees, preferably about 100 degrees. Optionally, the angle is within the range of from about 95 to about 115 degrees. Preferably, the ends of the cleaning teeth are sharp cutting edges to cut through grass clippings and other debris lodged in the spike.

The preferred embodiments may further comprise bristles embedded in the brush handle, and a scraping element positioned on the second end.

The objectives of the present invention are also met by providing a method of cleaning an athletic shoe comprising swiping the sole of a shoe with a brush assembly which comprises at least one pair of cleaning teeth having a first section and a second section joined on an angle, wherein the angle is within the range of from about 85 to 170 degrees.

BRIEF DESCRIPTION OF THE DRAWINGS

FIG. 10(*b*) is a side plan view of the pair of cleaning teeth of FIG. 10(*a*).

DETAILED DESCRIPTION OF THE DRAWINGS

Figure 1:
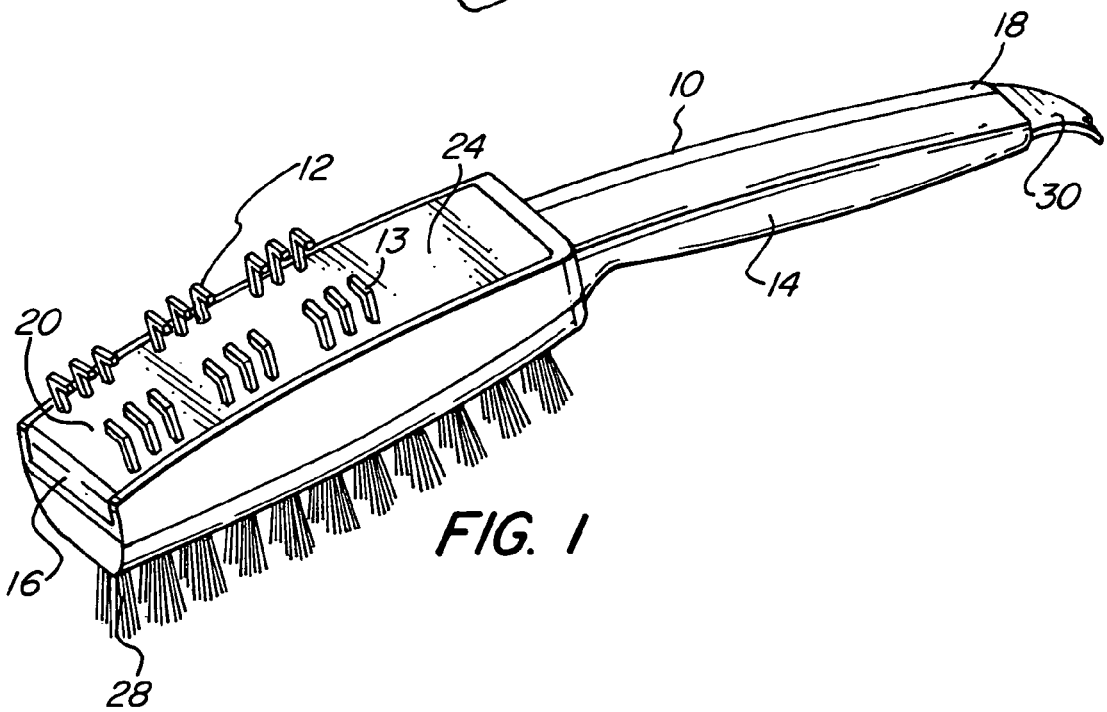
FIG. 1 is a front isometric view of a brush assembly with cleaning teeth in accordance with the present invention.

The present invention is directed to a brush assembly configured to hold at least one pair of cleaning teeth suitable for cleaning athletic shoe spikes. Most preferably, the brush assembly is configured for soft spike type golf shoes. Referring now to FIG. 1, there is shown a front isometric view of one preferred embodiment of brush assembly 10 with cleaning teeth 12 positioned in a predetermined location. Brush assembly 10 has a longitudinally extending brush handle 14 having a first end 16 and a second end 18. Brush handle 14 may be made out of any material suitable for making a brush such as plastic, thermoplastic, graphite, or wood. First end 16 has an upper face 20 and a lower face 22 (not shown in FIG. 1). Upper face 20 has first substantially flat portion 24. In some embodiments, lower face 22 (not shown in FIG. 1) has a second flat portion 26 (not shown in FIG. 1) which is substantially parallel to flat portion 24. At least one bristle 28 is shown extending from second flat portion. Scraping element 30 is also shown connected to second end 18 of brush handle. Scraping element 30 may be made out of any suitable material for scraping shoes such as metal, plastic or wood. Preferably scraping element 30 has a longitudinal curve to facilitate scraping a shoe while still on the wearer's foot.

Figure 2:
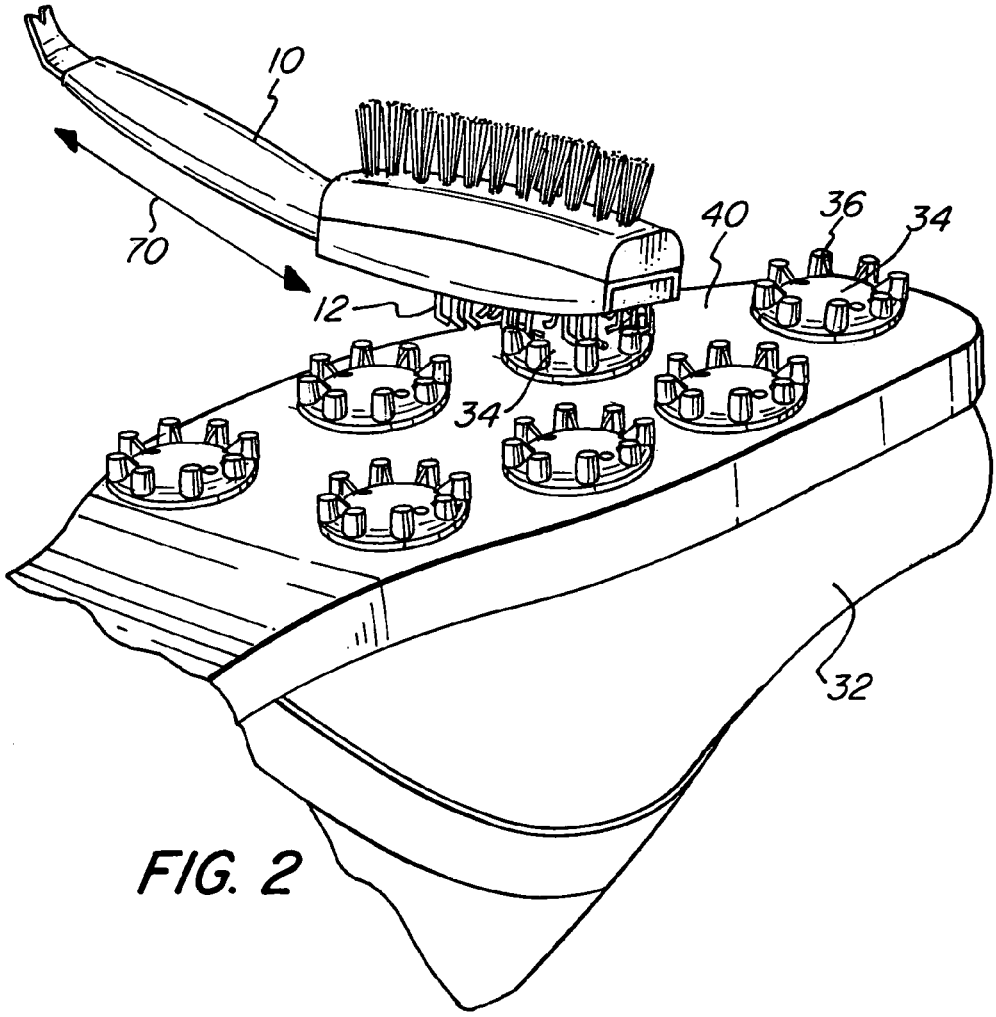
FIG. 2 is an isometric view of the brush assembly of FIG. 1 in contact with the sole of an athletic shoe.

Referring now to FIG. 2, an isometric view of cleaning teeth 12 affixed to a brush assembly 10 is shown in contact with athletic shoe 32. Athletic shoe 32 has an alternative soft type spike 34 having multiple nubs or flanges 36. The circular arrangement of nubs or flanges 36 along with the separation between the shoe sole 40 from the ends of the nubs or flanges 36 contributes to clogging of the spike 34 with debris. Brush assembly 10 is uniquely designed with cleaning teeth 12 in order to remove debris from nub 36 and spike 34. Arrow 70 on figure FIG. 2 represents a back and forth reciprocating motion of brush assembly 10 along the sole of shoe 32 to clean the spikes 34. It is expected that after at least one swipe of brush assemble 10 against the sole of shoe 32, will cause cleaning teeth 12 to pass through spike 34. The angled shape of cleaning teeth 12 allows the second section of the cleaning teeth 12 to pass between the sole 40 of golf shoe 32 and the flanges 36, and causes debris to be lifted up and out of the spike, thus unclogging spike 34. Preferably, the cleaning teeth 12 are fabricated from aluminum, steel, or rigid plastics, and are provided with sharpened tip ends 13 that can cut through grass clippings and other debris. Brush assembly 12 is small enough to be hand-held such that a user can bend over or back to swipe the sole of athletic shoe 34 while wearing still wearing the shoe.

Figure 3:
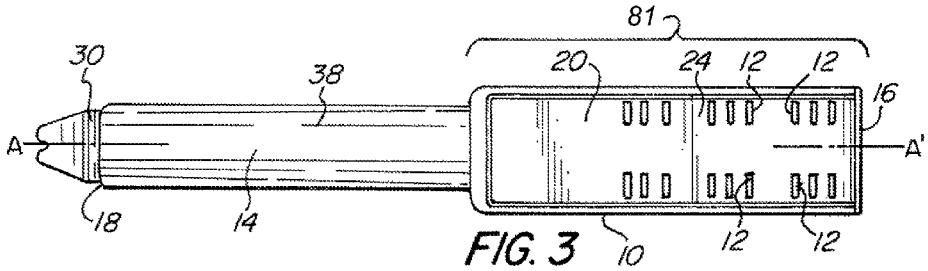
FIG. 3 is top plan view of brush assembly of FIG.1.

Referring now to FIG. 3, a top plan view of brush assembly of FIG.1 is shown having longitudinal axis A-A'. Brush assembly 10 has longitudinally extending brush handle 14 having a first end 16 and a second end 18. Brush handle 14 is also shown having head area 36 positioned adjacent to grip region 38. Brush handle 14 may be of any workable length, however, brush handle 14 is typically between about 10 cm and 30 cm in length, preferably about 25 cm in length. Brush handle may have a width and a height between about 1 cm to 5 cm, preferably about 3.5 cm. First end 16 has upper face 20 which may be approximately 5 cm in length, and equal to the approximate width of handle 14. Upper face 20 has first substantially flat portion 24. A plurality of cleaning teeth 12 are shown positioned upon upper face 20. Pairs of cleaning teeth 12 are shown placed in groups of three, placed adjacently on the same side of longitudinal axis A-A'. Scraping element 30 is also shown connected to second end 18 of brush handle 14. Scraping element 30 may have a width approximately equal to the width of handle 14, and a length between about 1 to 5 cm. Scraping element 30 may be made out of any material suitable for scraping shoes such as plastic or metal. Moreover, scraping element 30 is shown bent in a curved direction such that it curves away from longitudinal axis A-A'.

Figure 4:
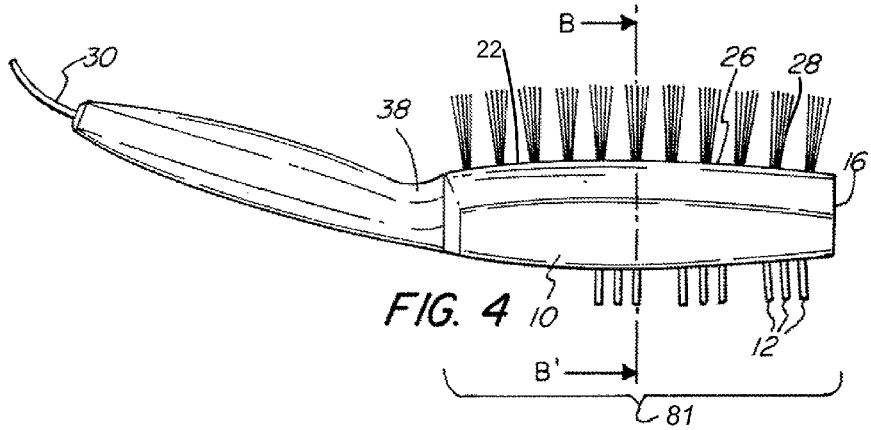
FIG. 4 is a side view of the brush assembly of FIG. 1.

Referring now to FIG. 4, a side plan view of brush assembly 10 is shown having transverse axis B-B'. A curved portion of grip region 38 connects grip region 38 to head region 36. A plurality of cleaning teeth 12 are shown positioned on brush assembly 10. Cleaning teeth 12 are shown placed in groups of three cleaning teeth placed adjacent to one another. Such placement allows brush assembly 10 to cover a larger surface area of shoe when brushed. First end 16 has second flat portion 26. Clusters or groups of bristles 28 are shown extending away from second flat portion 26 in a direction substantially similar to axis B-B'. Bristle 28 is sufficiently stiff for scrubbing an athletic shoe and may be made from any suitable material such as plastic. Bristle 28 may be between about 0.5 cm to about 5 cm in length, preferably about 2 cm in length.

Figure 5:
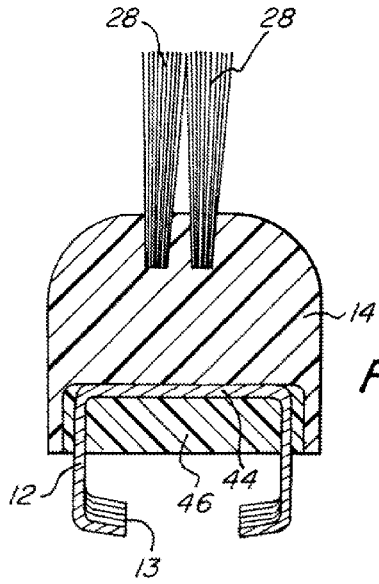
FIG. 5 is a cross sectional front plan view of the brush assembly of FIG. 1.

FIG. 5 is a front cross sectional view the brush assembly of FIG. 4 along transverse axis B-B'. The cleaning teeth 12 are shown as part of a substantially C shaped element. Base 44 of cleaning teeth 12 crosses through handle 14 such that it is positioned between handle 14 and retaining block 46. Cleaning teeth 12 are supported by having base 44 placed between retaining block 46 and handle 14. Cleaning teeth 12 extend away from brush handle 14. A plurality of bristles 28 is also shown extending away from brush handle 14.

Figure 6:
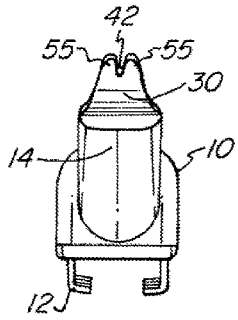
FIG. 6 is a rear plan view of the brush assembly of FIG. 1.

FIG. 6 is a rear plan view of the brush assembly 10 of FIG. 1. Scraper 30 is shown extending away from brush handle 14 in the opposite direction of cleaning teeth 12. Notch 42 in the center of scraper 30 contributes to debris removal from athletic shoes by creating two substantially pointed ends 55. Pointed ends 55 are useful for thrusting into the sole of a golf shoe to remove dried debris or mud which may have cemented onto the sole of a shoe.

Figure 7:
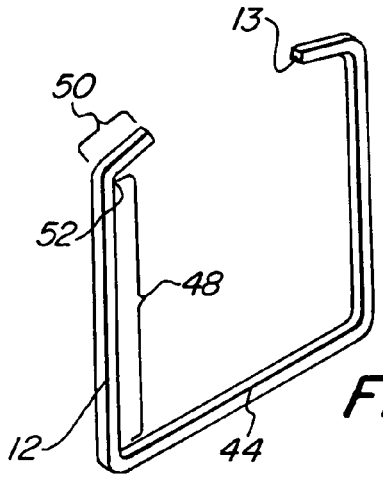
FIG. 7 is a side plan view of a pair of cleaning teeth of the present invention.

Referring now to FIG. 7 the preferred cleaning teeth 12 of the present invention are shown. Pairs of cleaning teeth 12 are formed of a substantially C shaped element which provides a pair of cleaning teeth 12 in one component part which can be embedded by molding in a plastic brush handle. Each one of the pairs of cleaning teeth 12 has base 44, a first section 48 and a second section 50 separated by angle 52. Angle 52 is an important component for ensuring that the cleaning teeth appropriately contact the flanges/nubs on the spike of the athletic shoe. Angle 52 may be within the range of from about 95 to about 160°, more preferably within the range of from about 90 to about 120°, more preferably within the range of from about 95 to about 115°. Most preferably, angle 52 is equal to about 100 degrees between first section 48 and second section 50.

Figure 8:
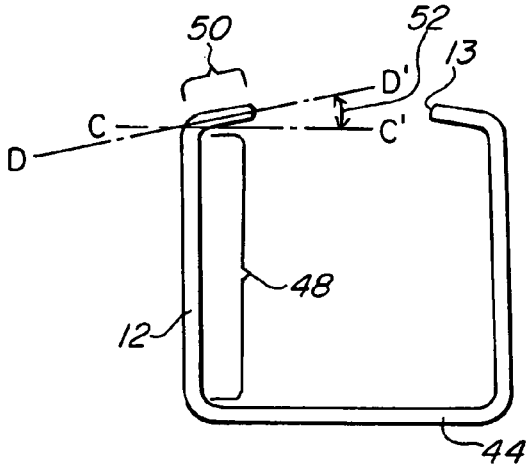
FIG. 8 is a front plan view of the pair of cleaning teeth of FIG.7.

Referring now to FIG. 8, a preferred embodiment of the cleaning teeth 12 of the present invention is shown. Each of the pairs of cleaning teeth 12 has base 44, a first section 48 and a second section 50 separated by angle 52. Axis C-C' and D-D' are shown throughout angle 52. Axis C-C' is perpendicular to first section 48. Perpendicular meaning that when it intersects with first section 48, it forms what looks to be a T shaped structure. Axis D-D' is shown extending through second section 50. The angle formed between axis C-C' and D-D' is approximately ten degrees. Accordingly, the angle between first section 48 and second section 50 is 100 degrees.

Figure 9:
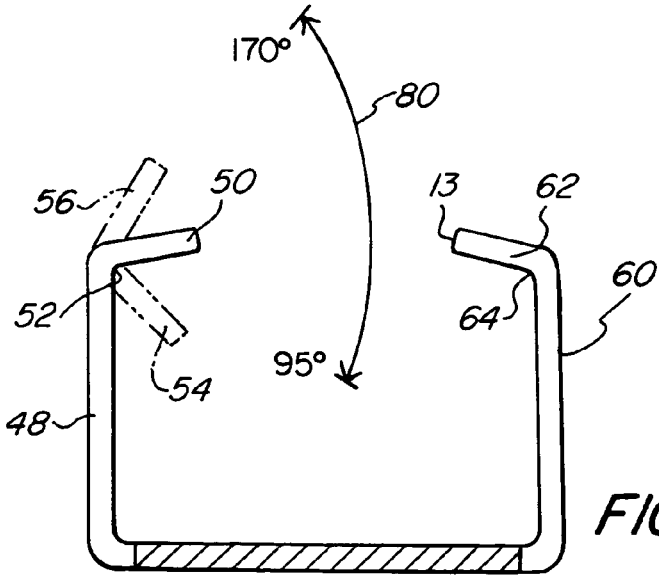
FIG. 9 is a schematic plan view of the pair cleaning teeth of FIG. 7 showing alternative degrees of the angle.

FIG. 9 is a schematic plan view of cleaning teeth 12 of the present invention showing a variety of acceptable degrees of angle 52 on cleaning teeth 12. First section 48 and second section 50 are shown with angle 52 of approximately 100 degrees. First section is between 15 to 20 mm in length, preferably 18.63 mm. Second section 54 and second section 56 are shown in phantom to illustrate the possible angle 52 openings between 95 to about 170 degrees. Second section 50 is between 4 to 8 mm in length preferably about 6.25 mm. First section and second section are approximately 1.5 mm thick. Arrow 80 refers to all of the acceptable degrees including the range of from about 95 to about 170 degrees, the range of from about 90 to about 120 degrees, the range of from about 95 to about 115 degrees. The most preferable angle 52 is equal to about 100 degrees between first section 48 and second section 50. FIG. 9 also shows third section 60 extending away from base 44. Fourth section 62 is connected to third section 60 by second angle 64. As shown in FIG. 9 it is preferable that fourth section 62 points towards second section 50. In preferred embodiments, opposing third section 62 is spaced about 17.5 mm away from the end of second section 50. In preferred embodiments, angle 52 is approximately the same degree as angle 64. Preferably, angle 52 and angle 64 are approximately 100 degrees, most preferably 100 degrees. In preferred embodiments base 40 is approximately 30 mm in length and 1.5 mm thick.

Figure 10A:
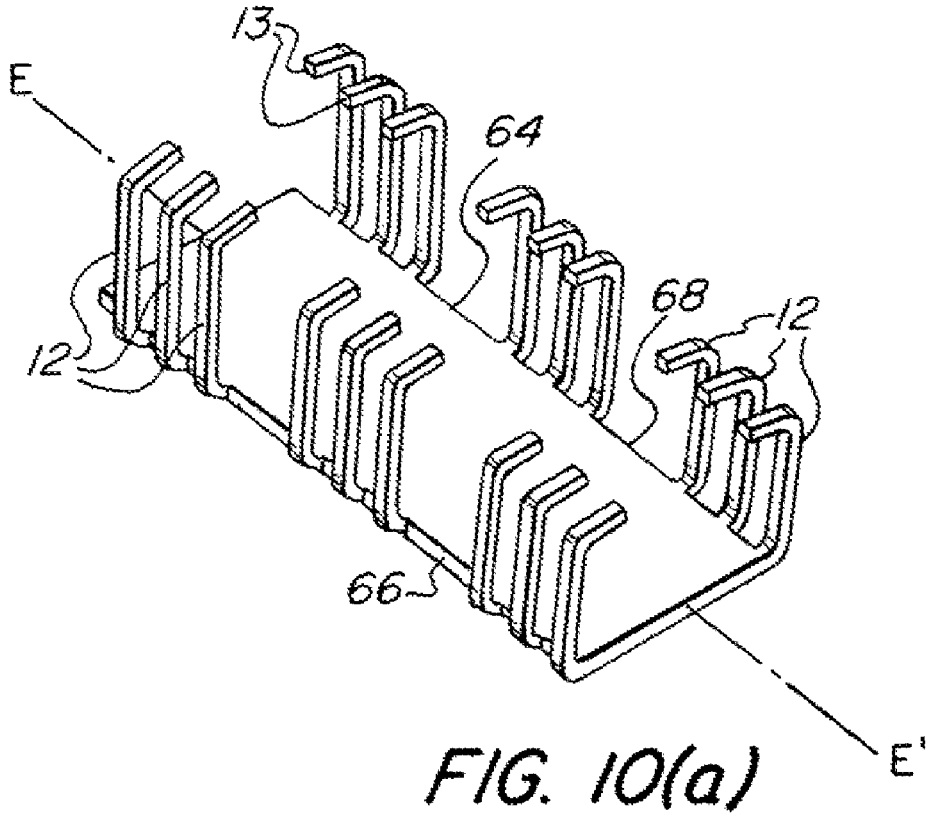
FIG. 10(*a*) is a top plan view of a preferred embodiment of a pair of cleaning teeth.
Figure 10B:
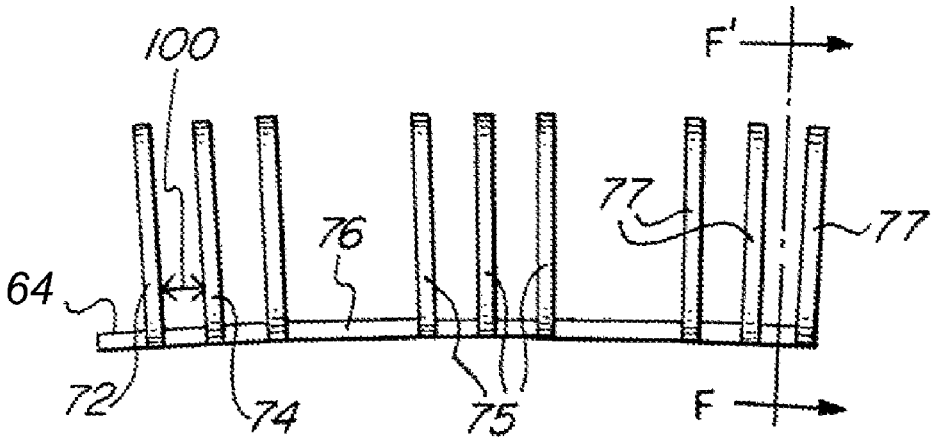

Referring now to FIG. 10(*a*) a top plan view of another embodiment of the cleaning teeth is shown. Rack 64 has a base having a first side 66 and a second side 68. A plurality of cleaning teeth 12 are interspersed along first side 66 and second side 68 in a predetermined position. Axis E-E' extends throughout the center of rack 64 in a longitudinal direction. Rack 64 may be of any workable length, however, preferably between 2 and 15 cm in length, more preferably about 7 cm, most preferably 66 mm. Cleaning teeth 12 may be bundled in groups of three along first side and/or second side, or placed at an appropriate width such that when brushed against a soft spike, at least one of the cleaning teeth is able to pass through the soft spike. Cleaning teeth 12 may be bundled in groups of three such that three cleaning teeth extend away from axis E-E' such that it is transverse to the axis, and three cleaning teeth are positioned within approximately one cm. Preferably, and as shown in FIG. 10(*b*), a 1 to 1.5 mm gap 100 may be positioned between cleaning teeth (72, 74). Bundles 75 and 77 are shown separated by approximately 12 mm. Preferably, all cleaning teeth are positioned such that the tip of the cleaning teeth points substantially towards axis E-E'.

FIG. 10(*b*) is a side plan view of the embodiment shown in FIG. 10. Bundle 75 and bundle 77 each comprise three cleaning teeth 12. Axis F-F' is shown passing transversely through the longitudinal axis of the embodiment. Base 76 is shown, making up substantial portion of rack 64. Cleaning teeth 12 extend away from base 76. When rack 64 is inserted into a handle or holding implement, cleaning teeth extend away from the center of the brush, such that only one end is affixed to the brush.

The assembly of the present invention may be fabricated from a variety of materials, with some preferred materials being metal such as steel, aluminum, brass and the like, wood, and plastic. Alternatively, some parts of the assembly may be wood or fabricated from polymeric materials, with fairly high strength engineering polymers such as polycarbonate, and fiber reinforced composites. Rack 64 may be made of any metal. The metal may be selected to be strong enough to be repeatedly swiped against a hard plastic. Rack 64 may be manufactured by methods known in the art and machine punched from a sheet of metal.

Obviously, many modifications may be made without departing from the basic spirit of the present invention. Accordingly, it will be apreciated by those skilled in the art that within the scope of the appended claims, the invention ma be practiced other than has been specifically described herein.

What is claimed is:

1. An athletic shoe cleaning device comprising:

a handle having a first end having a face and a longitudinal axis;

a plurality of pairs of opposing cleaning teeth, each of said cleaning teeth having a substantially linear first section extending upwardly from said face and a second section joined to an upper portion of said first section at an angle of between about 85 to about 170 degrees;

wherein the second sections of each pair of opposing cleaning teeth extend towards each other in a direction transverse to the longitudinal axis of the handle; and wherein the length of the first section is between about 15 to 20 mm and the length of the second section is between about 4to 8 mm; and wherein said handle first end has a second face with bristles extending therefrom.

2. The athletic shoe cleaning device of claim 1 wherein the angle is between about 95 to about 160 degrees.

3. The athletic shoe cleaning device of claim 1 wherein the angle is between about 90 to about 120 degrees.

4. The athletic shoe cleaning device of claim 1 wherein the angle is between about 95 to about 115 degrees.

5. The athletic shoe cleaning device of claim 1, wherein said cleaning teeth are formed of a stiff material and are provided with sharp cutting ends.

6. The athletic shoe cleaning device of claim 1 wherein said handle has a second end with a scraping element affixed thereto.

7. An athletic shoe cleaning device comprising:

a handle having a first end having a face;

a plurality of pairs of opposing cleaning teeth, each of said cleaning teeth being formed of a stiff material and having a substantially linear first section extending upwardly from said face and a second section joined to an upper portion of said first section at an angle of between about 85 to about 170 degrees, wherein said pairs of cleaning teeth are centered on a longitudinal axis of the handle with said second sections of said cleaning teeth extending towards each other transversely to the longitudinal axis, said cleaning teeth being provided with sharp ends; and wherein the length of the first section is between about 15 to 20 mm and the length of the second section is between about 4 to 8 mm; and wherein said handle first end has a second face with bristles extending therefrom.

8. The athletic shoe cleaning device of claim 7 wherein said handle has a second end with a scraping element affixed thereto.

9. The athletic shoe cleaning device of claim 8 wherein the angle is between about 95 to about 160 degrees.

10. The athletic shoe cleaning device of claim 8 wherein the angle is between about 90 to about 120 degrees.

11. The athletic shoe cleaning device of claim 8 wherein the angle is between about 95 to about 115 degrees.

12. The athletic shoe cleaning device of claim 8 wherein the angle is approximately 100 degrees.

13. The athletic shoe cleaning device of claim 7 wherein the angle is between about 95 to about 160 degrees.

14. The athletic shoe cleaning device of claim 7 wherein the angle is between about 90 to about 120 degrees.

15. The athletic shoe cleaning device of claim 7 wherein the angle is between about 95 to about 115 degrees.

* * * * *